US005407868A

United States Patent [19]

Peters et al.

[11] Patent Number: 5,407,868

[45] Date of Patent: Apr. 18, 1995

[54] METHOD OF MAKING AN ELECTRODE TIP FOR A TUNNEL CURRENT SENSING DEVICE

[75] Inventors: Rex B. Peters, Woodinville; James R. Woodruff, Redmond, both of Wash.

[73] Assignee: AlliedSignal Inc., Morris Township, Morris County, N.J.

[21] Appl. No.: 988,591

[22] Filed: Dec. 8, 1992

[51] Int. Cl.[6] ..... H01L 21/306

[52] U.S. Cl. ..... 437/228; 156/628; 156/649; 437/901

[58] Field of Search ..... 73/517 R, 517 B; 156/628, 648, 649, 662; 437/228, 901

[56] References Cited

U.S. PATENT DOCUMENTS

| | | | |
|---|---|---|---|
| 4,472,239 | 9/1984 | Johnson et al. . | |
| 4,507,170 | 3/1985 | Myhre . | |
| 4,614,119 | 9/1986 | Zavracky et al. . | |
| 4,711,128 | 12/1987 | Boura . | |
| 4,783,237 | 11/1988 | Aine et al. . | |
| 4,808,549 | 2/1989 | Mikkor et al. | 437/60 |
| 4,841,773 | 6/1989 | Stewart . | |
| 4,882,933 | 11/1989 | Petersen et al. . | |
| 4,891,984 | 1/1990 | Fujii et al. . | |
| 4,928,203 | 5/1990 | Swindal et al. . | |
| 4,996,877 | 3/1991 | Stewart et al. . | |
| 5,129,981 | 7/1992 | Wang et al. | 156/628 |
| 5,129,982 | 7/1992 | Wang et al. | 156/628 |

OTHER PUBLICATIONS

Waggener et al., "Control of Silicon Etch Rates in Hot Alkaline Solutions by Externally Applied Potentials", Electrochem. Soc. Ext. Abstract No. 237, pp. 587–589, Fall Meeting (1972).

Waggener, "Electrochemically Controlled Thinning of Silicon", The Bell System Technical Journal, Mar. 1970, pp. 473–475.

Wang et al., "The Application of Transcient Electrochemical Biasing for Selective Silicon Etching", Publication Unknown (Date Unknown), pp. 1–28.

H. Seidel, "The Mechanism of Anisotropic, Electrochemical Silicon Etching in Alkaline Solutions", IEEE Solid-State Sensor and Actuator Workshop, Hilton Head Island, pp. 86–91 (1990).

Smith et al., "The Potential Dependence of Silicon Anisotropic Etching in Koh at 60° C." J. Electroanal. Chem 238 (1987) 103–113.

Glembocki et al., "Bias-Dependent Etching of Silicon in Aqueous Koh", J. Electrochem. Soc: Solid-State Science & Technology, vol. 132, No. 1, Jan. 1985, pp. 145–151.

*Primary Examiner*—Olik Chaudhuri
*Assistant Examiner*—Ken Horton
*Attorney, Agent, or Firm*—Howard G. Massung

[57] ABSTRACT

A method for selectively etching a semiconductor wafer in the presence of an electrochemical etchant wherein the electrical potential of the area that is selectively etched is automatically changed to a potential at which the etching is inhibited once the desired etching in the area is completed. The method is described with respect to making an electrode tip for a tunnel current sensing device.

19 Claims, 2 Drawing Sheets

METHOD OF MAKING AN ELECTRODE TIP FOR A TUNNEL CURRENT SENSING DEVICE

BACKGROUND OF THE INVENTION

1. Field of the Invention

The present invention is directed to a method for selectively etching a semiconductor wafer. More particularly, the present invention is directed to a method for making electrode tips for tunnel current sensing devices in silicon.

2. Background of the Art

The Kenny et al article entitled "Electron Tunnel Sensor Technology", presented at the first national conference and exhibition of NASA's technology for transfer in November of 1990, describes a micromachined servo accelerometer that utilizes a tunnel current sensor. The accelerometer is micromachined from silicon and includes a cantilever spring with an integral electrode tip.

The electrode tips are formed directly from the silicon substrate. An oxide-coated surface is first patterned by photolithography to leave only a 60 um×60 um square of oxide for each tip. When etched in EDP, the edges of the oxide are undercut. When the undercutting is complete, the square of oxide is carried away leaving a pyramid-shape silicon tip. The active surface of the tips are prepared by evaporation of a 3000 Angstrom Au film through a shadow mask. A gold film is deposited over the tip to form a tunnel current electrode.

One deficiency associated with the foregoing method is that the wafer must be removed from the etchant after the masking material becomes detached. This deficiency becomes particularly noticeable when multiple electrode tips are created on a single wafer or on multiple wafers. The tips are very susceptible to the etchant and the first tips to be completed may be partially etched away before etching of the remaining electrode tips.

SUMMARY OF THE INVENTION

The present invention provides a method for selectively etching an area of a semiconductor wafer. After the area has been selectively etched, further etching of the area is automatically inhibited even though other areas of the semiconductor wafer remain subject to etching by the etchant.

Generally described, the method of the invention is accomplished by providing first and second conductive paths respectively to first and second regions of the area of the semiconductor wafer that is to be selectively etched. The first conductive path is connected to a first voltage potential which is at a potential which allows etching by an etchant that is to be used. The second conductive path includes a resistor through which a second voltage potential is supplied. The second voltage potential is at a potential which inhibits etching of the semiconductor wafer by the etchant, The etchant undercuts the first region of the semiconductor wafer and eventually disconnects the area of the semiconductor wafer from the first conductive path. With the area disconnected from the first conductive path, the effect of the resistor becomes negligible and the potential of the area approaches the potential of the second voltage potential. Since the area is then at the second voltage potential, further etching of the area is inhibited.

In a particular embodiment of the invention, the method is used to create multiple electrode tips for tunnel current devices on a silicon wafer. The silicon wafer has a doped substrate which is provided with an oppositely doped epitaxial layer. The epitaxial layer is etched to create an island for each tip that is to be made. An insulating layer is applied to the silicon wafer; however, at least two regions of each island are left exposed. Thus, each island is left with first and second uninsulated regions. A first conductive path is provided to the respective first region of each island and a second conductive path is provided to the respective second region of each island. The second conductive path includes a resistor respectively associated with each island. The first conductive path is connected to a first voltage potential which is at a potential which allows the etchant to freely etch each of the electrode tips. The second conductive path is connected to a second voltage potential which is at a potential which inhibits etching of the wafer by the etchant. The second voltage potential is supplied to the island through the respective resistor so that the island remains at the first potential so long as the island is electrically connected to the first conductive path. The silicon wafer is subject to the etchant which respectively undercuts each of the first regions to form the electrode tips. As each respective tip successfully becomes fully formed, a space is created between the first conductive path and the respective tip thereby disconnecting the tip from the first voltage potential. This causes the potential of the island to approach the potential of the second voltage potential and inhibits further etching of the island and electrode tip.

BRIEF DESCRIPTION OF THE DRAWINGS

The objects and features of the present invention may be further understood by reference to the following detailed description of the preferred embodiments taken in conjunction with the accompanying drawings of which.

DETAILED DESCRIPTION OF THE PREFERRED EMBODIMENT

Figure 1:
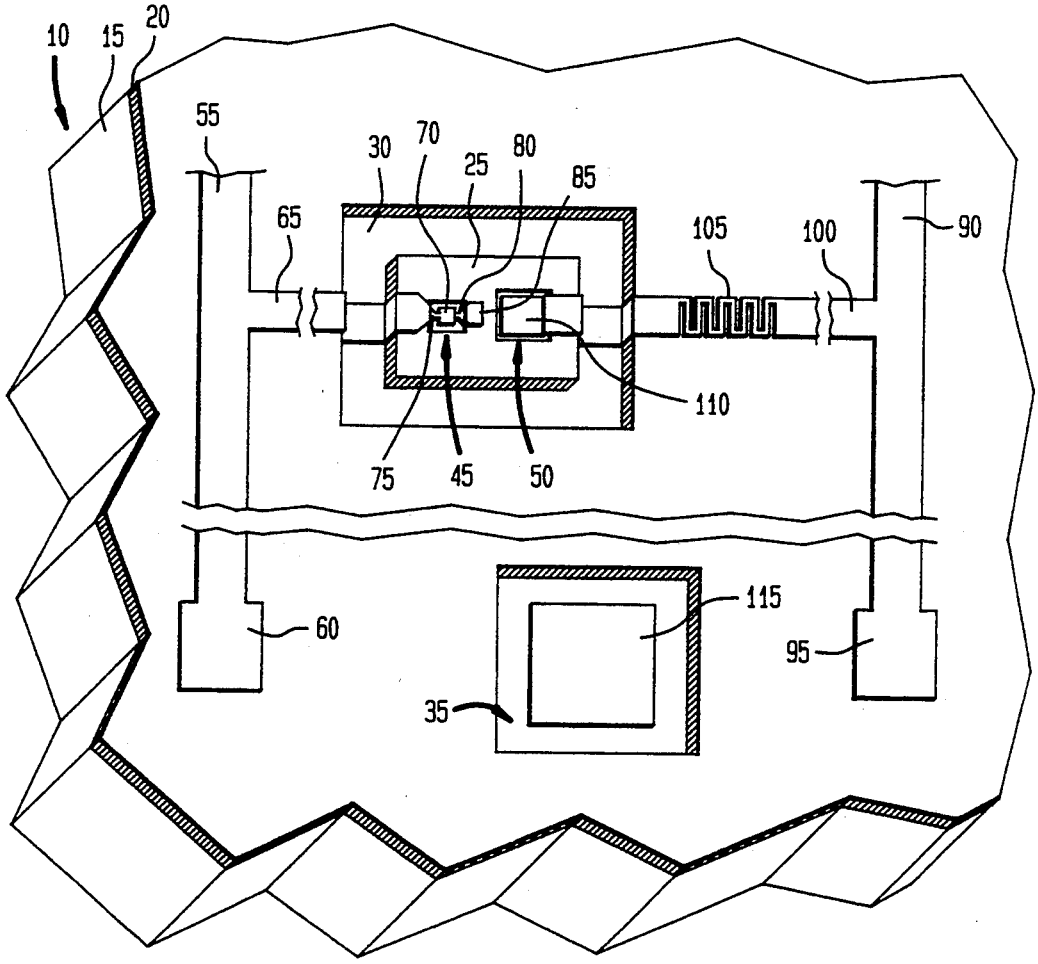
FIG. 1 is a perspective view of a semiconductor wafer that has been prepared to construct an electrode tip in accordance with the method of the present invention.
Figure 2:
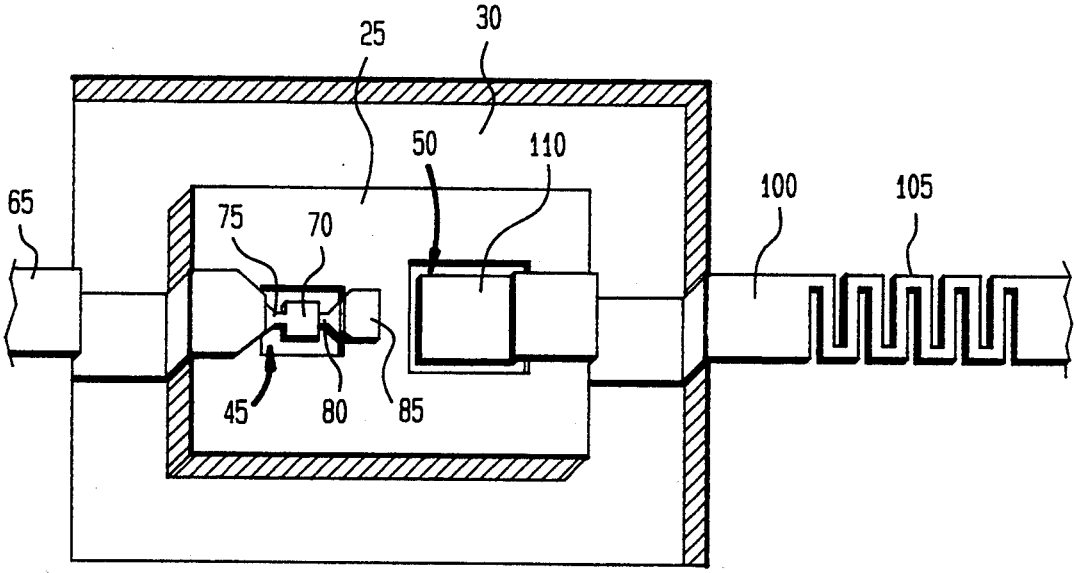
FIG. 2 is a closer view of the island of FIG. 1 on which the electrode tip is to be formed.
Figure 3:
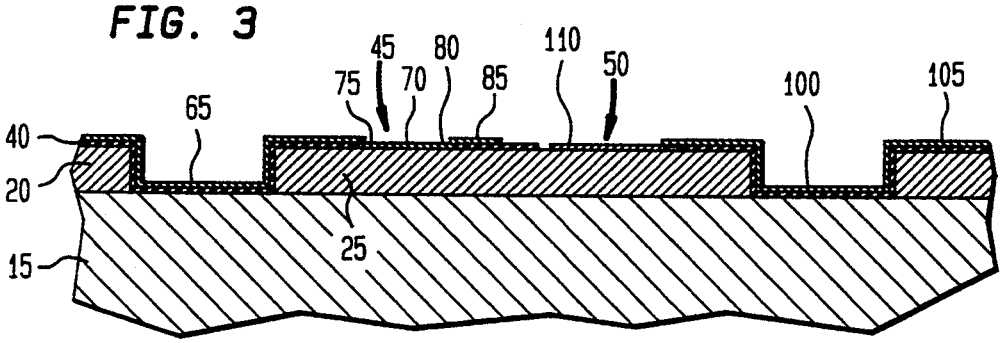
FIG. 3 is a cross sectional view of the island of FIG. 1.

The method of the invention is best described with respect to the semiconductor wafer 10 shown in FIGS. 1 through 4. The semiconductor wafer 10 includes a p-doped silicon substrate 15 which serves as a base and has its surfaces normal to the <100> crystal face. An n-doped epitaxial layer 20 is grown on the surface of the p-doped substrate 15. The epitaxial layer 20 in the preferred embodiment is approximately 20 micrometers thick.

Using standard photolithographic techniques, the epitaxial layer 20 is etched through to the substrate 15 to form an island 25. Although only one island is shown, an island is formed for each electrode tip that is to be fabricated on the semiconductor wafer 10. Each island of epitaxy 25 is isolated by an isolation region 30 which has been etched through to the substrate 15.

The epitaxial layer 20 is also etched through to the substrate 15 to form a substrate connection region 35. Other areas of the epitaxial layer 20 may also be structured by the etching. These structured portions of the epitaxial layer may provide a bonding site where the wafer 10 is joined with, for example, a cover plate having a corresponding tunnel sensor electrode.

A patterned insulating layer 40 is applied over the exposed surfaces of the semiconductor wafer 10. The insulating layer 40 may be formed as a layer of silicon nitride, silicon oxide, or both. The insulating layer is masked using photolithography techniques and etched leaving exposed first and second regions 45, 50 on the island 25. First and second regions 45, 50 are thus not covered by the insulating layer 40. Additionally, the substrate connection region 35 is not covered by the insulating layer.

Metallization is applied to the semiconductor wafer 10 after the patterned insulating layer 40 has been etched to form the first and second exposed regions 45 and 50. The metallization is patterned to form at least two conductive paths. The conductive paths are preferably made from gold and are structured using standard pattern forming techniques.

The first conductive path includes a first bus bar 55 which is common to all of the islands. The first bus bar 55 is connected to a first bus supply pad 60. A metal branch strip 65 extends from the first bus bar 55 to each island 25. A substantially square metallization pad 70 is connected to two oppositely extending metal support strips 75, 80. One metal support strip 75 connects the metallization pad 70 to the branch strip 65. The other metal support strip 80 connects the metallization pad 70 to an anchor pad 85. The metallization pad 70 is in electrical contact with the epitaxial layer 20 in the first exposed region 45 of the island 25.

The second conductive path includes a second bus bar 90 which is also common to all of the islands. The second bus bar is connected to a second bus supply pad 95. A second metal branch strip 100 extends from the second bus bar 90 to each island 25 through a resistor 105. A second metallization pad 110 is connected to the branch strip 100 and is placed in electrical contact with the epitaxial layer 20 in the second exposed region 50 of the island 25. The second metallization pad 110 is preferably formed to cover substantially all of the second exposed region 50 thereby limiting any undercutting of the epitaxial layer 20 beneath the region 50 when the wafer 10 is exposed to the etchant.

A metal substrate connection 115 is applied to the substrate 15 in the substrate connection region 35. This allows application of a voltage potential to the substrate 15.

Certain electrochemical etchants, such as KOH, have etch rates which are dependent on the electrical potential of the semiconductor. For example, and without limitation, a positive electrical potential applied to silicon in the presence of a KOH etchant results in a decrease in the etching rate by a factor of several hundred. This etchant property is advantageously utilized in the method of the present invention.

The semiconductor wafer 10 is subject to a KOH etchant or the like. While subject to the etchant, the first conductive path and the substrate connection pad are held at a first voltage potential. In the embodiment described herein, the first potential is the same potential as the KOH etchant. The bus bar 90 of the second conductive path is connected to a second voltage potential at which the etch rate of the etchant is inhibited. This second voltage potential is thus supplied to the island 25 through the resistor 105. In the embodiment described herein, the second potential is positive with respect to the KOH etchant.

Figure 4:
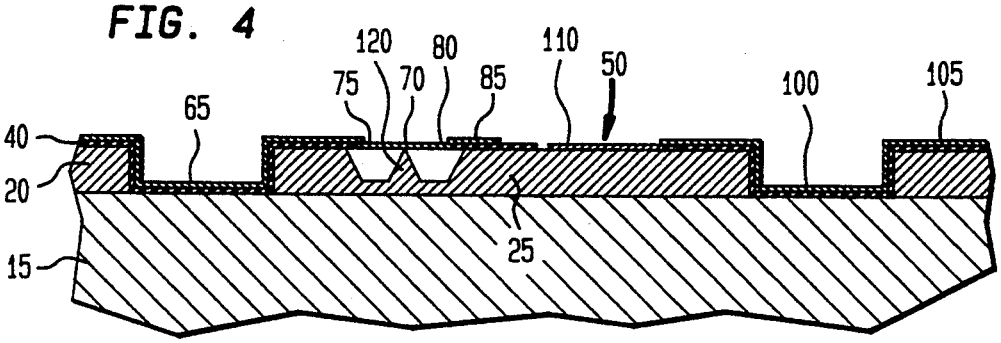
FIG. 4 is a view of the island of FIG. 3 after etching of the electrode tip.

The island 25 is initially held at the first potential because it is connected to the first conductive path by the substantially square metallization pad 70. Since the first region 45 connected to the metallization pad 70 is not protected while it is at the first voltage potential, the first region 45 is undercut until it forms an electrode tip 120 as shown in FIG. 4. The etchant continues to undercut the first region 45 until the electrode tip is no longer in contact with the metallization pad 70.

Once the electrode tip 120 is no longer in contact with the metallization pad 70, the island 25 is effectively disconnected from the first conductive path and the first voltage potential. Since the island 25 is then effectively connected only to the second conductive path at the second metallization pad 110, the effect of the resistor becomes negligible and the potential of the island 25 approaches the second voltage potential. This inhibits further etching of the electrode tip 120 or that particular island while allowing the remaining electrode tips on the other islands to be completed. Thus, the wafer 10 need not be removed from the etchant as each electrode tip is successively completed. Rather, the potential of each island will automatically approach the second voltage potential as the respective electrode tip is completed and will thus be protected.

In the embodiment described herein, the n-doped island, after completion of etching, is at a positive potential with respect to the p-doped substrate, so that the junction between the island and the substrate forms a back-biased diode.

While several embodiments of the invention have been described hereinabove, those of ordinary skill in the art will recognize that the embodiments may be modified and altered without departing from the central spirit and scope of the invention. Thus, the preferred embodiments described hereinabove are to be considered in all respects as illustrative and not restrictive, the scope of the invention being indicated by the appended claims rather than by the foregoing description. Therefore, it is the intention of the inventor to embrace herein all changes which come within the meaning and range of equivalency of the claims.

What is claimed is:

1. A method for selectively etching an area of a semiconductor wafer comprising the steps of:

holding said area of said semiconductor wafer at a first voltage potential at which an etchant will freely etch said area;

subjecting said semiconductor wafer to said etchant to etch said area;

automatically causing said area to approach a second voltage potential once said etching of said area is completed, said second voltage potential being at a potential which inhibits further etching of said area by said etchant, including providing first and second conductive paths to said area, said first conductive path being maintained at said first voltage potential, said second conductive path including a resistor, said second conductive path being connected to said second voltage potential to supply said second voltage potential to said area through said resistor; and allowing said etchant to etch said area to disconnect said area from said first conductive path thereby allowing the potential of said area to approach said second voltage potential.

2. A method for selectively etching a semiconductor wafer comprising the steps of:

providing a first conductive path to a first region of an area of said semiconductor wafer that is to be selectively etched;

providing a second conductive path to a second region of said area of said semiconductor wafer, said second conductive path including a resistor;

maintaining said first conductive path at a first voltage potential, said first voltage potential being at a potential which allows an etchant to freely etch said semiconductor wafer; and connecting said second conductive path to a second voltage potential, said second voltage potential being at a potential with respect to said etchant which inhibits the etch rate of said etchant, said second voltage potential being supplied to said second region of said area through said resistor;

subjecting said semiconductor wafer to said etchant to undercut said area of said semiconductor wafer in said first region to disconnect said area of said semiconductor wafer from said first conductive path and thereby allow the potential of said area to approach said second voltage potential and inhibit further etching by said etchant.

3. A method as claimed in claim 2 wherein said step of providing a first conductive path comprises the steps of:

providing said semiconductor wafer as a doped silicon substrate having an oppositely doped epitaxial layer;

etching said epitaxial layer to form an island of epitaxy, said first region being disposed on said island;

depositing an insulating layer over said semiconductor wafer while leaving said first region free of said insulating layer; and forming a patterned metallization layer on said semiconductor wafer as said first conductive path, said patterned metallization layer electrically contacting said island at said first region.

4. A method as claimed in claim 3 wherein said step of forming a patterned metallization layer comprises the steps of:

forming a bus bar;

forming a branch strip that extends from said bus bar;

forming a substantially square metallization pad and an anchor pad on said island; and forming first and second support strips, said first support strip connecting said branch strip to said substantially square metallization pad, said second support strip connecting said anchor pad to said substantially square metallization pad.

5. A method as claimed in claim 2 wherein said step of providing a second conductive path comprises the steps of:

providing said semiconductor wafer as a doped silicon substrate having an oppositely doped epitaxial layer;

etching said epitaxial layer to form an island of epitaxy, said second region being disposed on said island;

depositing an insulating layer over said semiconductor wafer while leaving said second region free of said insulating layer; and forming a patterned metallization layer on said semiconductor wafer as said second conductive path, said patterned metallization layer electrically contacting said island at said second region.

6. A method as claimed in claim 5 wherein said step of forming a patterned metallization layer comprises the steps of:

forming a bus bar;

forming a branch strip that extends from said bus bar, said branch strip including said resistor; and forming a metallization pad connected to said branch strip, said metallization pad making electrical contact with said second region on said island.

7. A method as claimed in claim 2 wherein the step of subjecting said semiconductor wafer to said etchant is further defined by subjecting said semiconductor wafer to a KOH etchant.

8. A method as claimed in claim 7 wherein the step of connecting said second conductive path to a second voltage potential is further defined by connecting said second conductive path to a second voltage potential which is positive with respect to said KOH etchant.

9. A method for making a tip for a tunnel current device comprising the steps of:

providing a first conductive path to a first region of an area of said semiconductor wafer that is to be selectively etched to make said tip;

providing a second conductive path to a second region of said area of said semiconductor wafer, said second conductive path including a resistor;

maintaining said first conductive path at a first voltage potential, said first voltage potential being at a potential which allows an etchant that is to be used to freely etch said semiconductor wafer to make said electrode tip;

connecting said second conductive path to a second voltage potential through a resistance, said second voltage potential being at a potential with respect to said etchant which inhibits the etch rate of said etchant; and subjecting said semiconductor wafer to said etchant to undercut said area of said semiconductor wafer in said first region to form said electrode tip and disconnect said area of said semiconductor wafer from said first conductive path upon complete formation of said tip thereby allowing the potential of said area to approach said second voltage potential and inhibit further etching of said electrode tip by said etchant.

10. A method as claimed in claim 9 wherein said step of providing a first conductive path comprises the steps of:

providing said semiconductor wafer as a doped silicon substrate having an oppositely doped epitaxial layer;

etching said epitaxial layer to form an island of epitaxy, said first region being disposed on said island;

depositing an insulating layer over said semiconductor wafer while leaving said first region free of said insulating layer; and forming a patterned metallization layer on said semiconductor wafer as said first conductive path, said patterned metallization layer electrically contacting said island at said first region.

11. A method as claimed in claim 10 wherein said step of forming a patterned metallization layer comprises the steps of:

forming a bus bar;

forming a branch strip that extends from said bus bar;

forming a substantially square metallization pad and an anchor pad on said island; and forming first and second support strips, said first support strip connecting said branch strip to said substantially square metallization pad, said second support strip connecting said anchor pad to said substantially square metallization pad.

12. A method as claimed in claim 9 wherein said step of providing a second conductive path comprises the steps of:

providing said semiconductor wafer as a doped silicon substrate having an oppositely doped epitaxial layer;

etching said epitaxial layer to form an island of epitaxy, said second region being disposed on said island;

depositing an insulating layer over said semiconductor wafer while leaving said second region free of said insulating layer; and forming a patterned metallization layer on said semiconductor wafer as said second conductive path, said patterned metallization layer electrically contacting said island at said second region.

13. A method as claimed in claim 12 wherein said step of forming a patterned metallization layer comprises the steps of:

forming a bus bar;

forming a branch strip that extends from said bus bar, said branch strip including said resistor; and forming a metallization pad connected to said branch strip, said metallization pad making electrical contact with said second region on said island.

14. A method as claimed in claim 9 wherein the step of subjecting said semiconductor wafer to said etchant is further defined by subjecting said semiconductor wafer to a KOH etchant.

15. A method as claimed in claim 14 wherein the step of connecting said second conductive path to a second voltage potential is further defined by connecting said second conductive path to a second voltage potential which is positive with respect to said KOH etchant.

16. A method for making a plurality of electrode tips for tunnel current devices on a semiconductor wafer comprising the steps of:

providing a semiconductor wafer having a doped substrate and an oppositely doped epitaxial layer;

etching said epitaxial layer of said semiconductor wafer to create an island for each electrode tip that is to be made;

providing an insulating layer to said semiconductor wafer except in respective first and second regions of each island;

providing a first conductive path to each said first region;

providing a second conductive path to each said second region, said second conductive path including a resistor respectively associated with each said second region;

maintaining said first conductive path at a first voltage potential, said first voltage potential being at a potential which allows an etchant that is to be used to freely etch each said tip;

connecting said second conductive path to a second voltage potential, said second voltage potential being at a potential with respect to said etchant which inhibits the etch rate of said etchant, said second voltage potential being supplied to each island through the associated resistor; and subjecting said semiconductor wafer to said etchant to respectively undercut each said first region to form said electrode tip and to disconnect each said island from said first conductive path once etching of said electrode tip is completed thereby allowing the potential of each said island to approach said second voltage potential upon completion of the respective electrode tip.

17. A method as claimed in claim 16 wherein said step of providing a semiconductor wafer is further defined by providing a semiconductor wafer having a doped silicon substrate and an oppositely doped epitaxial layer.

18. A method as claimed in claim 16 wherein the step of subjecting said semiconductor wafer to said etchant is further defined by subjecting said semiconductor wafer to a KOH etchant.

19. A method as claimed in claim 18 wherein the step of connecting said second conductive path at a second voltage potential is further defined by maintaining said second conductive path at a second voltage potential which is positive with respect to said KOH etchant.

* * * * *